US011519668B2

(12) United States Patent
Günter et al.

(10) Patent No.: US 11,519,668 B2
(45) Date of Patent: Dec. 6, 2022

(54) DEVICE FOR PREHEATING ROD-LIKE WORKPIECES

(71) Applicant: Extrutec GmbH, Moos (DE)

(72) Inventors: Uwe Günter, Gaienhofen (DE); Joachim Sokoll, Volkertshausen (DE)

(73) Assignee: Extrutec GmbH, Moos (DE)

( * ) Notice: Subject to any disclaimer, the term of this patent is extended or adjusted under 35 U.S.C. 154(b) by 0 days.

(21) Appl. No.: 17/279,647

(22) PCT Filed: Sep. 12, 2019

(86) PCT No.: PCT/EP2019/074412
§ 371 (c)(1),
(2) Date: Mar. 25, 2021

(87) PCT Pub. No.: WO2020/064360
PCT Pub. Date: Apr. 2, 2020

(65) Prior Publication Data

US 2022/0034587 A1 Feb. 3, 2022

(30) Foreign Application Priority Data

Sep. 25, 2018 (DE) ..... 20 2018 105 510.0

(51) Int. Cl.
*F27D 13/00* (2006.01)
*F27B 9/12* (2006.01)
*F27D 17/00* (2006.01)

(52) U.S. Cl.
CPC ..... *F27B 9/12* (2013.01); *F27D 13/00* (2013.01); *F27D 17/004* (2013.01); *F27B 2009/122* (2013.01)

(58) Field of Classification Search
CPC ..... F27D 17/004; F27D 3/0024; F27B 2009/122; B21J 1/02; B21J 17/00
See application file for complete search history.

(56) References Cited

U.S. PATENT DOCUMENTS 2,951,491 A * 9/1960 Olson ..... F27D 3/0024 134/159
4,135,704 A * 1/1979 Elhaus ..... C22F 1/04 198/774.1

(Continued)

FOREIGN PATENT DOCUMENTS

DE 102005058812 A1 6/2007
EP 0078446 A1 5/1983

(Continued)

OTHER PUBLICATIONS

Johne: Energiebedarf for eineoptimale Profilproduktion. Special Energy, Resources Environment, Sustainability. Aluminium, Dec. 2017, S. 46-52. URL: http://www.extrutec-gmbh.de/wpcontent/uploads/2016/03/Artikelextrutec-AJ0_17-12.pdf [abgerufen am Jul. 12, 2019].

(Continued)

*Primary Examiner* — Gregory A Wilson
(74) *Attorney, Agent, or Firm* — Bachman & LaPointe, P.C.

(57) ABSTRACT

A device for preheating rod-like, metal workpieces, in particular aluminium rods, by means of a fluid flow heated by residual heat or waste heat of a combustion process occurring in a heating device for heating the workpieces. The device has a preheating chamber for receiving at least one workpiece, wherein, in order to transfer the heat from the fluid flow to a heat transfer medium flow in a fluid flow line between a fluid flow connection and the preheating chamber, a heat-exchanger unit is provided in such a way that the workpiece is preheated indirectly via the heat transfer medium flow heated in the heat-exchanger unit by the fluid flow.

17 Claims, 6 Drawing Sheets

(56) References Cited

U.S. PATENT DOCUMENTS

| | | | | |
|---|---|---|---|---|
| 4,373,706 | A * | 2/1983 | Elhaus | C22F 1/04 266/259 |
| 4,776,391 | A * | 10/1988 | Warner | B01D 53/507 165/913 |
| 10,717,121 | B2 * | 7/2020 | Song | B21C 19/00 |
| 2012/0024284 | A1 * | 2/2012 | Guenter | F27B 9/38 126/85 R |

FOREIGN PATENT DOCUMENTS

| | | | | |
|---|---|---|---|---|
| FR | 1061294 | A | 4/1954 | |
| WO | WO-2007065623 | A1 * | 6/2007 | B22D 11/1213 |

OTHER PUBLICATIONS

International search report for patent application No. PCT/EP2019/074412 dated Nov. 15, 2019.

* cited by examiner

DEVICE FOR PREHEATING ROD-LIKE WORKPIECES

BACKGROUND OF THE INVENTION

The invention relates to a device for preheating rod-shaped, metallic workpieces, in particular aluminum rods, by means of a fluid flow heated by residual or waste heat of a combustion process taking place in a heating device for heating the workpieces, the device having a preheating chamber for receiving the workpiece.

Devices of the kind mentioned above are in particular used in combination with gas quick preheating ovens. In the state of the art, the exhaust gases generated in the gas quick preheating ovens are used to heat a preheating zone of the gas quick preheating oven. It is also known to use the exhaust gases which leave the gas quick preheating oven and still have a temperature of approximately 200° C. to 300° C. in order to pre-adjust the temperature of the combustion air of the gas quick preheating oven. Alternatively, it is known to transport the exhaust gases leaving the gas quick preheating oven into a preheating magazine, in particular into a rod preheating magazine, in order to preheat the material to be heated, in particular the rods, directly there.

The heating of the rod-shaped workpieces in the gas quick preheating ovens takes place via direct flame impingement of the material, wherein, as outlined above, it is already known to use the combustion air which is generated in the process and discharged from the gas quick preheating ovens as exhaust gas to preheat rod-shaped workpieces which are provided in a preheating magazine for the subsequent insertion in the gas quick preheating ovens. In these preheating magazines, which are already being used by the applicant, a direct application of the exhaust gas realized as fluid flow to the workpieces takes places in order to preheat the rod-shaped workpieces by guiding the fluid flow over the surface of the rod-shaped workpieces.

As a result of the relatively low heat capacity of a gas flow and the relatively short contact time between the gas molecules and the surface of the rod-shaped workpieces depending on the flow velocity, the efficiency in the heat transfer from the gaseous fluid flow to the rod-shaped workpieces is relatively low.

From DE 10 2005 058 812 A1, a device for heating at least one continuously cast bar is known in which a liquid discharge device extends parallel to a longitudinal axis in the reception area of workpieces disposed in the reception area of a preheating chamber, nozzles of the liquid discharge device being distributed as discharge openings over the entire circumference and a preheating transfer fluid being shot under high pressure at the continuously cast bar via the nozzles.

SUMMARY OF THE INVENTION

Therefore, the object of the invention is to propose a preheating device which has an improved efficiency.

To attain this object, the device according to the invention has the features as disclosed herein.

According to the invention, a heat exchanger device is provided between a fluid flow connection and the preheating chamber in a fluid flow line in order to transfer the heat from the fluid flow to a heat transfer medium flow, the heat exchanger device being provided in such a manner that the workpiece is preheated indirectly via the heat transfer medium flow heated by the fluid flow in the heat exchanger device.

The indirect preheating of the rod-shaped workpieces according to the invention, in which the workpieces are not exposed directly to the exhaust gas flow from the heating device, but which provides an intermediary heat transfer medium flow including the option of optimizing the fluid used for the realization of the heat transfer medium flow with respect to its heat transfer capacity, allows a significant increase in the effectiveness of the heat transfer from the exhaust gas flow to the workpiece.

In particular if the heat transfer medium flow is composed of a liquid, the wettability which is provided by a liquid compared to a gas and which allows a corresponding residence or contact time of the liquid on the workpiece can lead to a significant increase in effectiveness.

With respect to the handling in the process and with respect to the ready availability, it has proven advantageous for the heat transfer medium flow to be realized as a water flow.

In particular if the preheating chamber has the shape of a tube and a liquid discharge device disposed above a reception area for receiving the workpiece, the liquid discharge device being used to apply the heat transfer medium flow leaving the liquid discharge device to an upper side of the workpiece, the heat transfer medium flow preferably being realized as a water flow, particularly good results can be achieved in the heat transfer in combination with a particularly economical operation of the device, because the surface of the workpiece is wetted under the effect of gravity after the water flow has left the liquid discharge device when the liquid applied to the upper side of the workpiece can spread across the entire surface of the workpiece by gravity alone in the case of cylindrical workpieces.

A particularly simple realization of the device simultaneously having an effect on as much of the surface of the workpiece as possible is enabled if, according to the invention, the liquid discharge device extends parallel to the longitudinal axis of a workpiece disposed in the reception area of the preheating chamber.

According to the invention, the liquid discharge device has a row of discharge openings for realizing a largely continuous wetting on the upper side of the workpiece, the row of discharge openings extending in the longitudinal direction of the preheating chamber, a significant axial temperature gradient across the longitudinal axis of the workpiece thus being avoided during the preheating.

If the preheating chamber is realized as a through-flow chamber and has an inlet seal realized on a first end face and an outlet seal realized on an opposite end face, the preheating device can be integrated into a continuous operation of an overall system which, in a particularly advantageous embodiment, has a gas quick preheating oven next to the preheating device or downstream of the preheating device. The seals, i.e., the inlet and outlet seals, can be realized as sliding seals whose opening is adapted to the respective cross section, in particular the diameter, of the workpiece, a sliding contact of the seal, in particular of the opening, with the workpiece thus being realized.

The heat exchanger device and the preheating chamber are preferably disposed in a heat transfer medium cycle, a supply line being realized between the heat exchanger device and the preheating chamber and a return line being realized between the preheating chamber and the heat exchanger device.

If a heat transfer medium tank is disposed between the preheating chamber and the return line in such a manner that the heat transfer medium flow discharged from the liquid discharge device into the reception area of the preheating chamber is transported from the preheating chamber into the heat transfer medium tank and from the heat transfer medium tank into the heat exchanger device, a continuous operation of the heat transfer medium device, i.e., a continuous circulation of the heat transfer medium flow in the heat transfer medium device can be ensured despite the fact that the heat transfer medium flow is guided over the surface of the workpiece without pressure, i.e., by gravity. Furthermore, the heat transfer medium tank can be used for further intermediate heating of the heat transfer medium flow.

If a bypass line is disposed parallel to the preheating chamber between the supply line and the heat transfer medium tank, wherein the bypass line and a supply line section which connects the bypass line and the preheating chamber are each provided with a shut-off valve device, it is possible to heat at least a partial quantity of the heat flow circulating through the bypass line and the heat exchanger device, irrespective of the application of the heat flow to the workpiece in the preheating chamber, and to treat the workpiece disposed in the preheating chamber by a corresponding setting of the shut-off valve devices after reaching a defined target temperature of the heat flow.

The preheating chamber is preferably provided with a reception device for the supporting reception of the workpiece, wherein the reception device can be adapted to the workpiece geometry, which allows the reception device to be adapted in particular to the workpiece length.

The reception device is preferably realized as a transport device for transporting the workpiece in the longitudinal direction of the preheating chamber, a provision of a separate transport device in addition to the reception device thus not being necessary.

It proves particularly advantageous for the reception device to be realized as a rotation device for rotating the workpiece about the longitudinal axis of the workpiece, because the heat flow can thus be applied, in particular, to the entire surface of workpieces which, departing from a rotationally symmetrical cross section, have a polygonal cross section which has plane partial surfaces on the surface of the workpiece, for example, by a suitable rotation of the workpiece about the longitudinal axis of the workpiece in such a manner that liquid drainage due to gravity is possible on all partial surfaces.

Another particularly preferred embodiment of the device can provide that the heat transfer medium cycle comprises a cleaning device, in particular a high-pressure cleaning device, the cleaning device comprising at least one additional liquid discharge device for applying the heat transfer medium flow leaving the liquid discharge device to a surface of the workpiece. Particularly advantageously, this embodiment allows the heat transfer medium cycle and the heat transfer medium or heat transfer medium flow located therein to be used not only for the preheating of the workpiece, but also for the cleaning or pre-cleaning of the workpiece, only a single or common heat transfer medium cycle being particularly advantageously required and the heated or preheated heat transfer medium thus being also advantageously usable for the cleaning or pre-cleaning of the workpiece, the cleaning performance thus being increased and the preheating of the workpiece thus being further increased or at least not deteriorated or adversely affected.

Corresponding cleaning devices, in particular high-pressure cleaning devices, normally serve to remove impurities on the surface of the workpiece which result from the storage, the transport or the like. For example, the impurities can be dust, sand, fats, oils or aggressive impurities, such as animal excrement or the like.

Within the scope of the invention, it has been recognized that, in addition to the preheating of the workpiece, the pre-cleaning or cleaning of the workpiece can also be performed in a particularly advantageous and effective manner by the heat transfer medium flow available anyway, in particular if a heat transfer medium cycle is realized. The cleaning device can particularly advantageously be disposed downstream of the preheating chamber in the feed direction of the workpiece or in the transport direction of the workpiece. This results in the particular advantage that the surface of the workpiece is already preheated when it is processed or treated with the liquid discharge or heat flow discharge in the context of the cleaning device; in this way, pollution, adhering substances or impurities of the surface of the workpiece can be detached and removed or transported away in a simpler and improved manner by means of the heat transfer medium flow. This is advantageous also because no cleaning agents, such as surfactants, can usually be added or should be added to the heat transfer medium flow, because within the heat transfer medium cycle, the heat transfer medium flow is to be used not only for the cleaning of the workpiece but also for the preheating of the workpiece. Additionally, the disposal of the heat transfer medium or the change of the heat transfer medium in the course of regular cleaning or maintenance intervals, for example, is facilitated by eliminating the use of additives in the heat transfer medium flow, in particular by eliminating the use of cleaning agents.

Another preferred embodiment of the device can provide that the heat transfer medium cycle has a branch in the supply line between the heat exchanger device and the preheating chamber, the heat transfer medium being supplied to the cleaning device by means of the branch.

Therefore, the heat transfer medium or the heat transfer medium flow which is applied to the surface or upper side of the workpiece or which is used in other ways for the preheating of the workpiece has approximately the same preheating temperature, irrespective of whether it is discharged via the cleaning device or whether it is used and/or discharged within the preheating chamber.

Another particularly advantageous embodiment can provide that the cleaning device comprises a collection device which collects the heat transfer medium applied to the workpiece by means of the cleaning device. Particularly advantageously, this allows the heat transfer medium or the heat transfer medium flow to be returned into the heat transfer medium cycle after it has been applied to the surface of the workpiece as a cleaning fluid. The heat cycle can thus be operated as an actual cycle without significant consumption. The maintenance intervals mentioned above in which the heat transfer fluid or the heat transfer medium as a whole is changed shall remain unaffected.

Another particularly desirable embodiment of the device can provide that the collection device is realized as a common collection device of the cleaning device and of the liquid discharge device and/or the preheating chamber. The heat transfer medium cycle is thus realized in a particularly simple manner. In particular, a return or transfer of the heat transfer medium or the heat transfer medium flow into a return line can be ensured by the common collection device. In other words, this means that the common collection device of the cleaning device and the liquid discharge device or the preheating chamber constitutes the return or unification of the different paths of the heat transfer medium cycle, i.e., the preheating arm on the one side and the cleaning arm on the other side.

Another advantageous embodiment can provide that the supply line and/or the return line of the heat transfer medium cycle comprise(s) filter means for filtering dirt from the heat transfer medium cycle.

This ensures that the dirt or impurity particles detached from the surface of the workpiece in the course of the pre-cleaning or cleaning by means of the cleaning device do not enter the heat transfer medium cycle or remain in the heat transfer medium cycle or lead to wear or pollution of the components involved. Instead, particles of this kind are filtered from the heat transfer medium cycle.

BRIEF DESCRIPTION OF THE DRAWINGS

A preferred embodiment of the invention is explained in greater detail below on the basis of the drawing.

In the drawing.

DETAILED DESCRIPTION

Figure 1:
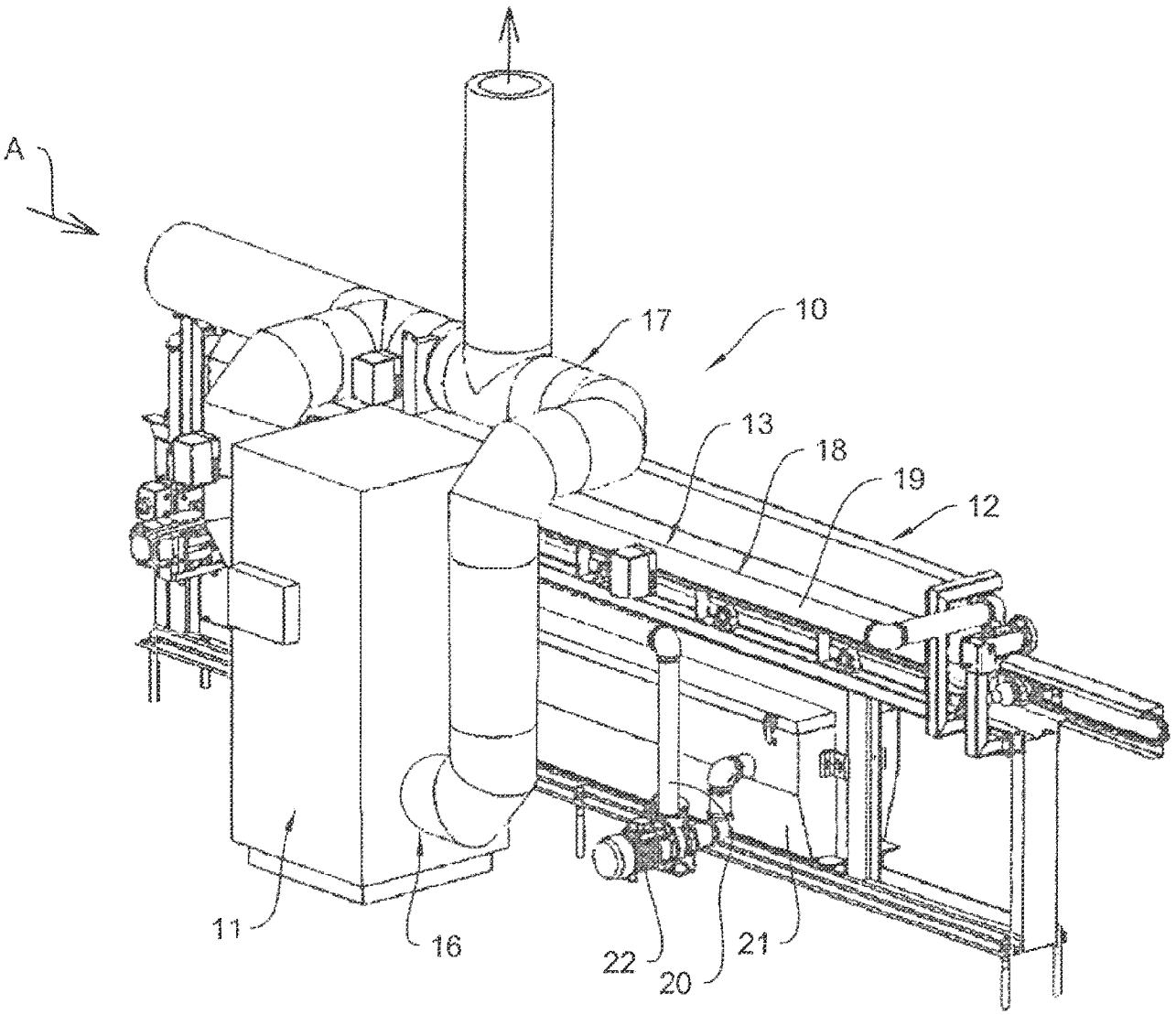
FIG. 1 shows a first view of a perspective representation of a preheating device.
Figure 2:
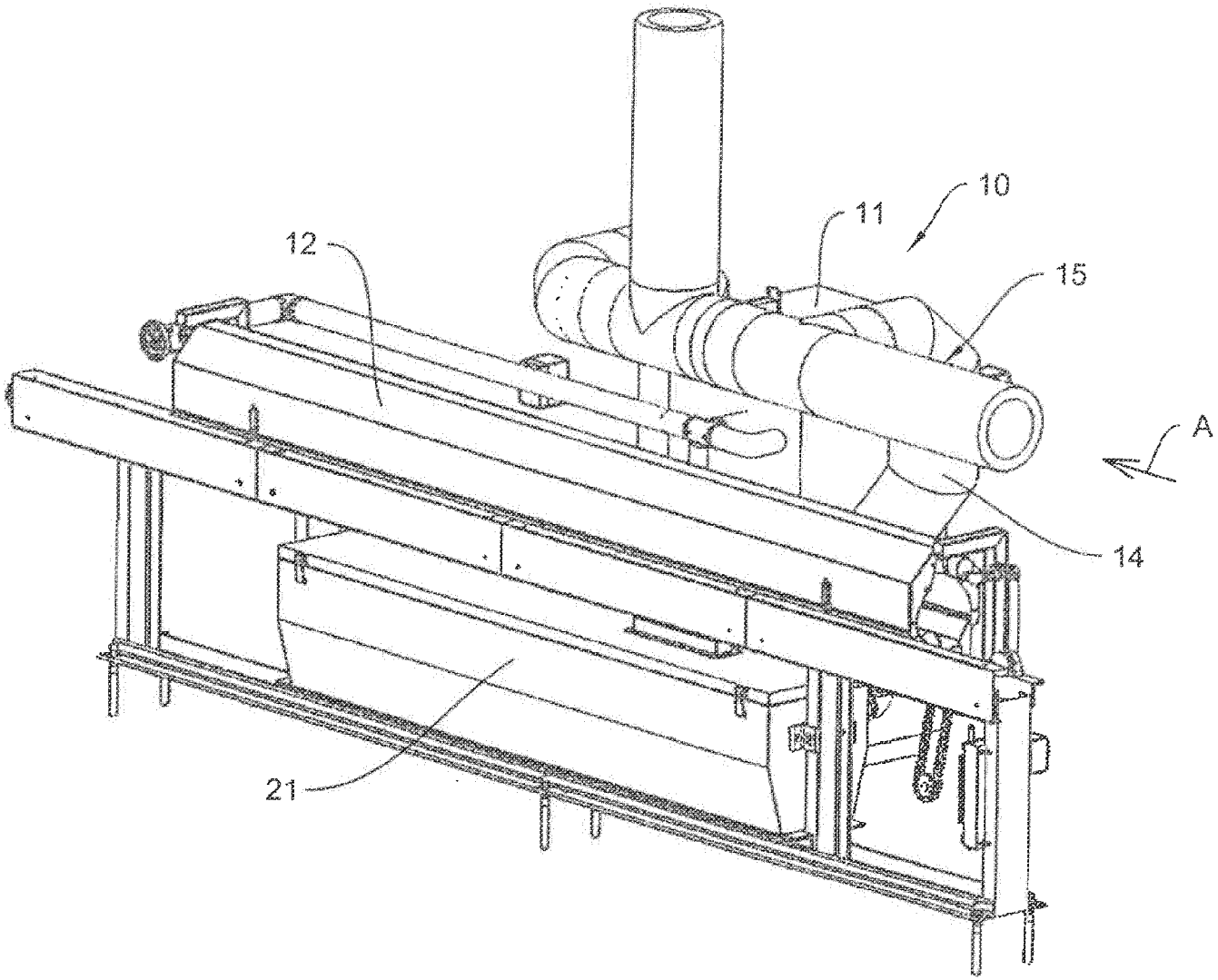
FIG. 2 shows a second view of a perspective representation of the preheating device.

FIGS. 1 and 2 show perspective representations of a preheating device 10 which has a heat exchanger device 11 and a preheating chamber 12 which are disposed in a heat transfer medium cycle 13. Heat exchanger device 11 is connected to a fluid flow line 15 via a fluid flow connection 14 in such a manner that an exhaust gas flow A which flows through fluid flow line 15 and which comes from a gas quick preheating oven (not shown in detail) passes through heat exchanger device 11 in fluid flow line 15. In the present case, heat exchanger device 11 is disposed in a fluid flow line section 16 of fluid flow line 15, fluid flow line section 16 being disposed parallel to a chimney connection section 17.

A heat transfer line 18 is provided in order to realize heat transfer medium cycle 13, a heat exchanger part (not shown in detail) of heat transfer line 18 being routed through heat exchanger device 11 in such a manner that heat is transferred between the heat exchanger part of heat transfer line 18 and the exhaust gas in fluid flow line 15.

In the present case, heat exchanger device 11 is designed in such a manner that water can be heated to a temperature of approx. 95° C. in the stationary operation of preheating device 10 by an exhaust gas volume flow which has a temperature of 250° C. to 300° C.

Figure 3:
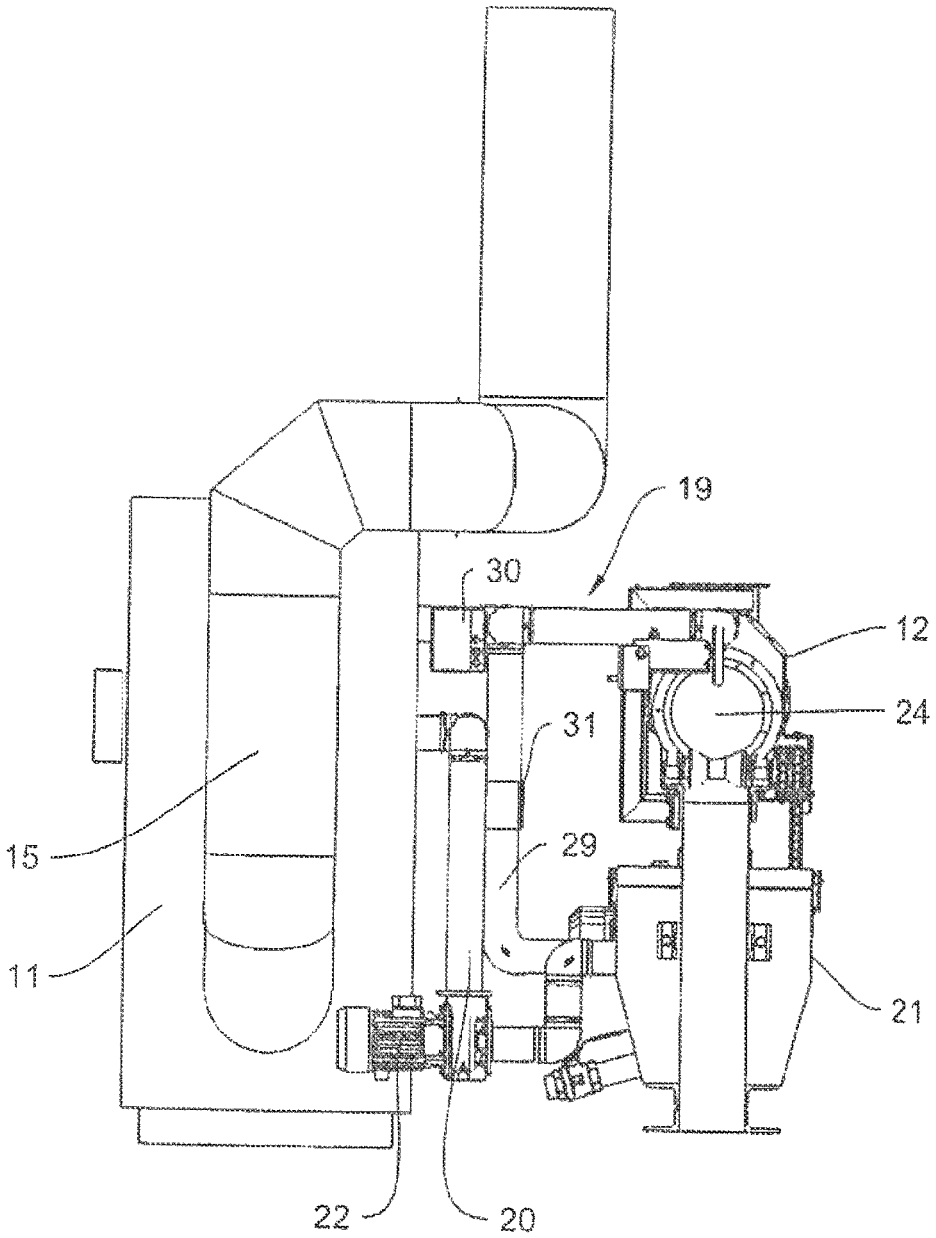
FIG. 3 shows a front view of the preheating device shown in FIG. 1.

As in particular FIG. 3 shows, heat transfer line 18 has a supply line 19 which is realized between heat exchanger device 11 and preheating chamber 12 and a return line 20 which leads from preheating chamber 12 back to heat exchanger device 11 and which has a heat transfer medium tank 21 in the present case. Furthermore, return line 20 is provided with a circulator pump device 22 which allows a continuous flow through heat transfer line 18 for the operation of heat transfer medium cycle 13 in such a manner that the water used as a heat transfer medium in the present case is conveyed through heat exchanger device 11, from heat exchanger device 11 via supply line 19 into preheating chamber 12 and from preheating chamber 12 into heat transfer medium tank 21 by means of circulator pump device 22, the water then returning from heat transfer medium tank 21 into heat exchanger device 11 via return line 20.

Figure 4:
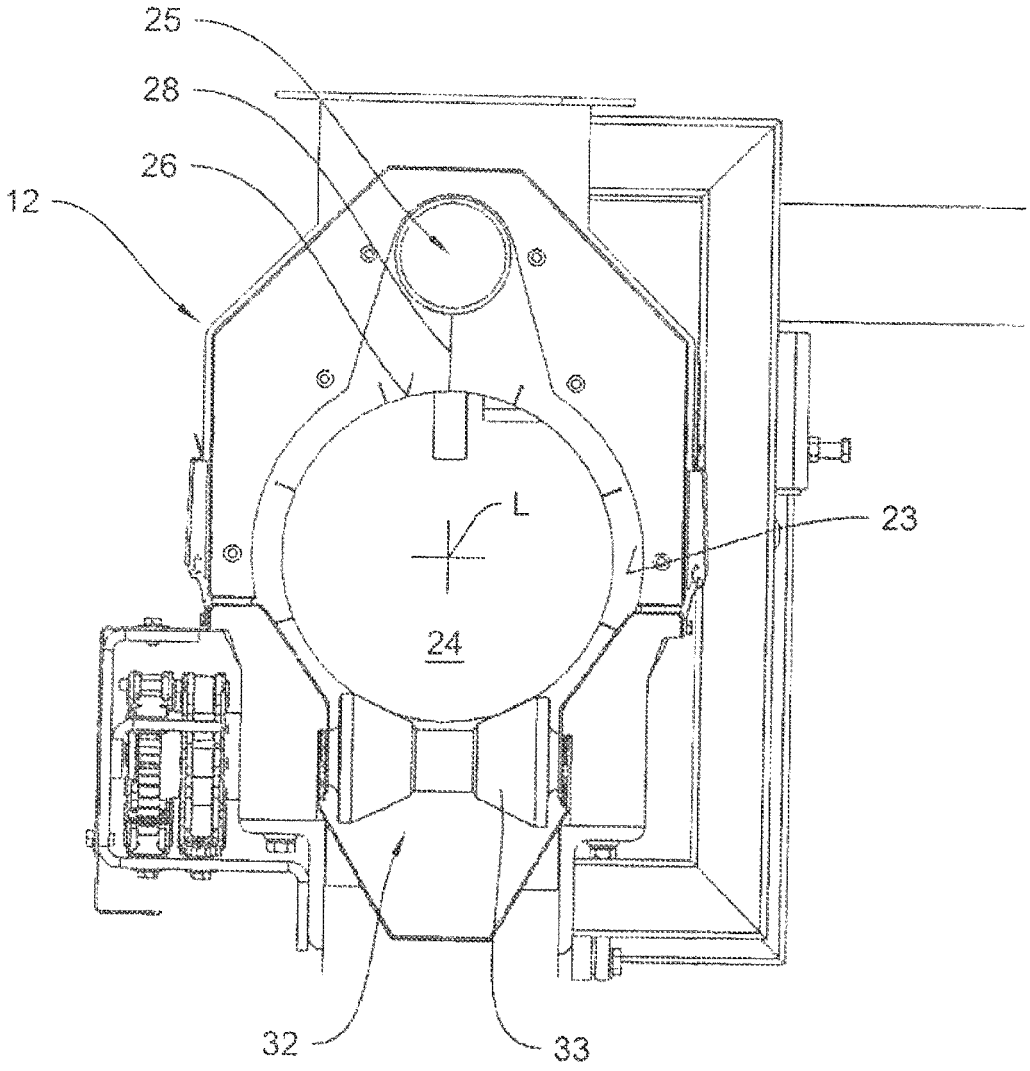
FIG. 4 shows a front view of an open preheating chamber of the preheating device shown in FIGS. 1 to 3.

As FIG. 4 shows, preheating chamber 12 is provided with a liquid discharge device 25, which has the shape of a tube in the present case, above a reception area 23 of preheating chamber 12 for treating a rod-shaped workpiece 24 which is disposed in reception area 23; the water can be applied to an upper side 26 of the workpiece via liquid discharge device 25. Liquid discharge device 25 extends parallel to a longitudinal axis L of preheating chamber 12, which corresponds to the longitudinal axis of workpiece 24 in the present case.

To discharge the water, liquid discharge device 25 has a row of discharge openings 28 which extends in the longitudinal direction of preheating chamber 12, discharge openings 28 allowing water to be applied to workpiece 24 essentially without pressure or at the feed pressure of circulator pump device 22. The essentially pressure-free application to upper side 26 of workpiece 24 allows as much of upper side 26 of workpiece 24 as possible to be wetted without a significant part of the water hitting surface 26 bouncing off surface 26. This ensures that essentially the entire amount of water applied to upper side 26 of workpiece 24 remains on the surface of workpiece 24 and, as a result of adhesion forces which enable wetting and of the influence of gravity, runs down the workpiece surface, the wetting surface continuously increasing in the process, a heat transfer across as much of the surface as possible thus being possible between the amount of water applied to upper side 26 of workpiece 24 and workpiece 24.

Discharge openings 28 realized in liquid discharge device 25 are preferably disposed at a distance of 80 mm to 100 mm; as a general principle, the viscosity of the heat transfer medium is to be taken into account with respect to both the distance and the diameter of the discharge openings to enable the essentially pressure-free application described above to upper side 26 of workpiece 24, the application realizing a continuous wetting surface.

After running down workpiece 24, the water is collected below workpiece 24 by a collection device which realizes heat transfer medium tank 21 and is then supplied to heat exchanger device 11 again via return line 20.

As in particular FIG. 3 shows, a bypass line 29 is provided, bypass line 29 connecting supply line 19 directly to heat transfer medium tank 21, both supply line 19 and bypass line 29 being provided with a shut-off valve device 30 and 31, respectively. In a corresponding valve position, i.e., when shut-off valve device 30 is closed and shut-off valve device 31 is open, the heat transfer medium flow in heat transfer medium cycle 13 can be limited to a flow through heat transfer device 11 via bypass line 29 bypassing preheating chamber 12, faster heating of the heat transfer medium thus being possible, if required, and a continuous operation of the preheating device remaining possible if no workpiece 24 is located in preheating chamber 12 or if workpieces 24 in preheating chamber 12 are changed.

As FIG. 4 shows, preheating chamber 12 is provided with a reception device 32 which allows workpiece 24 to be supported in preheating chamber 12 while also realizing a transport device since reception device 32 is realized with a plurality of transport shafts 33 which are disposed in the longitudinal direction of preheating chamber 12, wherein the transport device allows a transport of workpieces 24 through preheating chamber 12.

Figure 5:
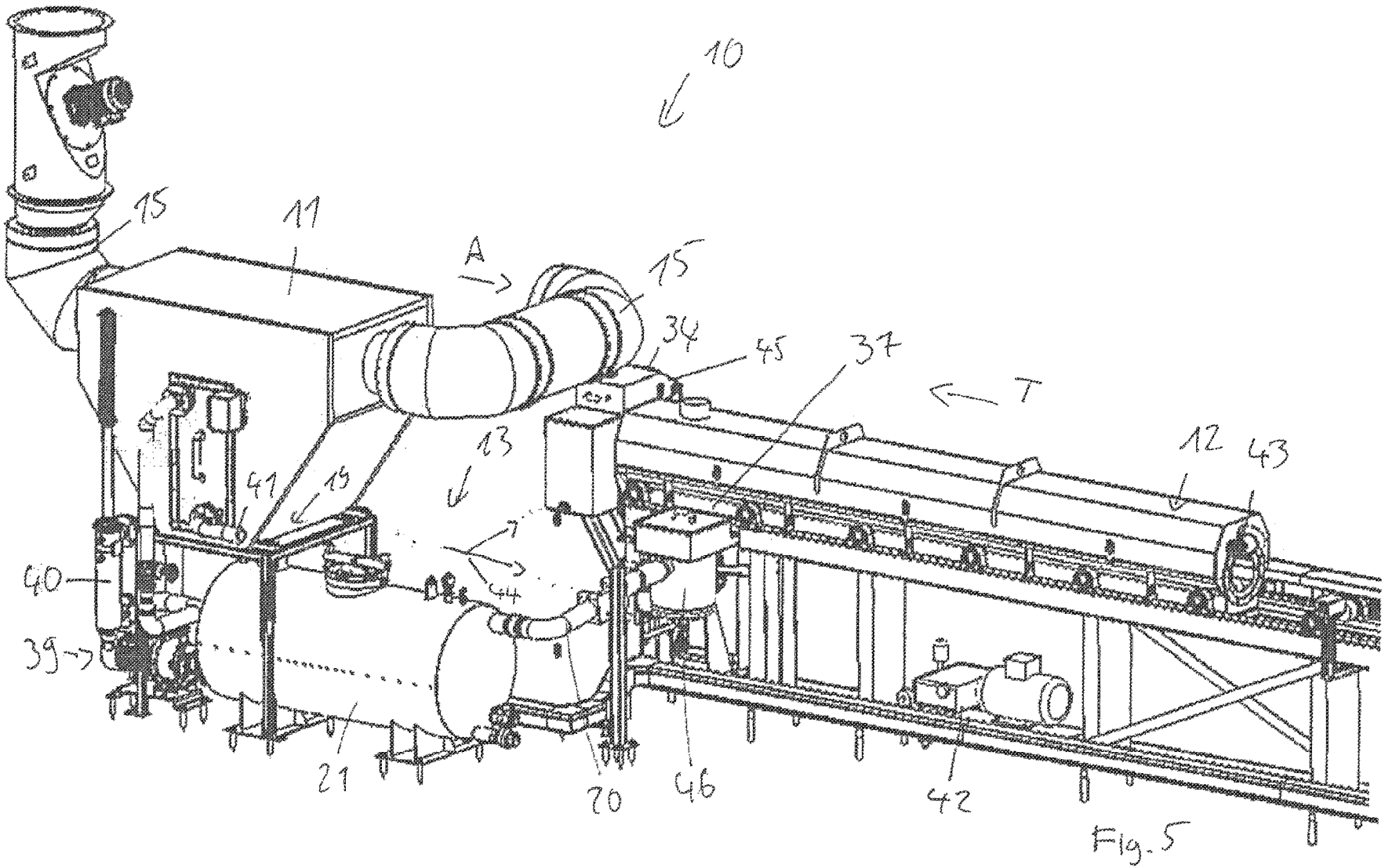
FIG. 5 shows a perspective representation of a preheating device according to a second embodiment.

FIG. 5 shows a perspective view of a second embodiment of preheating device 10 according to the invention; in this embodiment, a cleaning or pre-cleaning of the workpiece can be performed in addition to a preheating of the workpiece or workpieces, the cleaning or pre-cleaning being integrated into a heat transfer medium cycle for preheating the workpiece by means of preheating chamber 12.

As already shown in the embodiment of FIGS. 1 to 4, a heat exchanger device 11 is coupled to a gas quick preheating oven (not shown in detail) via fluid flow lines 15, an exhaust gas flow A coming from the gas quick preheating oven thus being routed through heat exchanger device 11 via fluid flow line 15. The functioning and the resulting advantages of the embodiment of FIG. 5 are described below with reference to the realization of heat transfer medium cycle 13. For the sake of clarity, the connections, in particular the pipelines, of heat transfer medium cycle 13 are not shown at individual points in FIG. 5. Instead, these connections are described or explained in words below.

The heat transfer medium, for example water, is stocked in a heat transfer medium tank 21. Heat transfer medium tank 21 can be insulated to minimize heat loss or heat radiation of the heat transfer medium located therein. The heat transfer medium, which is to be water throughout the following description, is pumped into heat exchanger device 11 via a circulator pump 39 and an automatic backwash filter 40 disposed downstream of circulator pump 39, the heat exchange with exhaust gas flow A taking place in heat exchanger device 11. The heat transfer medium flow leaves heat exchanger device 11 at an outlet 41 at which the illustration of the lines or pipelines realizing heat transfer medium cycle 13 is interrupted as well. From outlet 41, which forms part of supply line 19, the heat transfer medium flow is transported to a high-pressure pump 42 on the one side and an inlet 43 of preheating chamber 12 on the other side. In the course of the preheating in preheating chamber 12, essentially the same processes as described in relation to the embodiment of FIGS. 1 to 4 are performed, which is why these processes will not be discussed further at this point.

Branch 44 which is realized in supply line 19 and which supplies the heat transfer medium to preheating chamber 12 and to high-pressure pump 42 is a first branch or branch-off in heat transfer medium cycle 13. High-pressure pump 42 applies pressure to a part or an arm, namely the cleaning arm, of heat transfer medium cycle 13 in such a manner that the heat transfer medium or the water is transported or transferred from high-pressure pump 42 to cleaning device 34 under high pressure. The high-pressure water is then applied to the surface of the workpiece by the cleaning device, in particular the high-pressure cleaning device, by means of at least one corresponding additional liquid discharge device. With respect to the specific design of cleaning device 34, reference is made to the description of FIG. 6. The illustration of FIG. 5 already shows that cleaning device 34 has a housing 45. The illustration of FIG. 5 also indicates that a common collection device 37 in the form of a collection channel, for example, is realized below preheating chamber 12 and below cleaning device 34. The water or the heat transfer medium can be collected by means of collection device 37 after passing through preheating chamber 12, in particular after wetting the workpiece in the area of preheating chamber 12, and after being applied to the surface of the workpiece in the area of cleaning device 34. Collection device 37 thus serves as a meeting point or junction of the two arms of heat transfer medium cycle 13, namely the cleaning arm and the preheating arm.

The invention can provide that the heat transfer medium or the water is supplied from collection device 37 to a coarse dirt filter 46; accordingly, coarse dirt filter 46 is already part of a return line 20. Coarse dirt filter 46 can retain corresponding impurities and particles which have been detached from the workpiece, said impurities and particles thus not entering heat transfer medium tank 21 via return line 20. After passing through coarse dirt filter 46, the cleaned or processed water returns to heat transfer medium tank 21 via return line 20, heat transfer medium cycle 13 thus being closed.

Additionally, FIG. 5 shows that cleaning device 34 is disposed or connected downstream of preheating chamber 12 in transport direction T of the workpiece.

Figure 6:
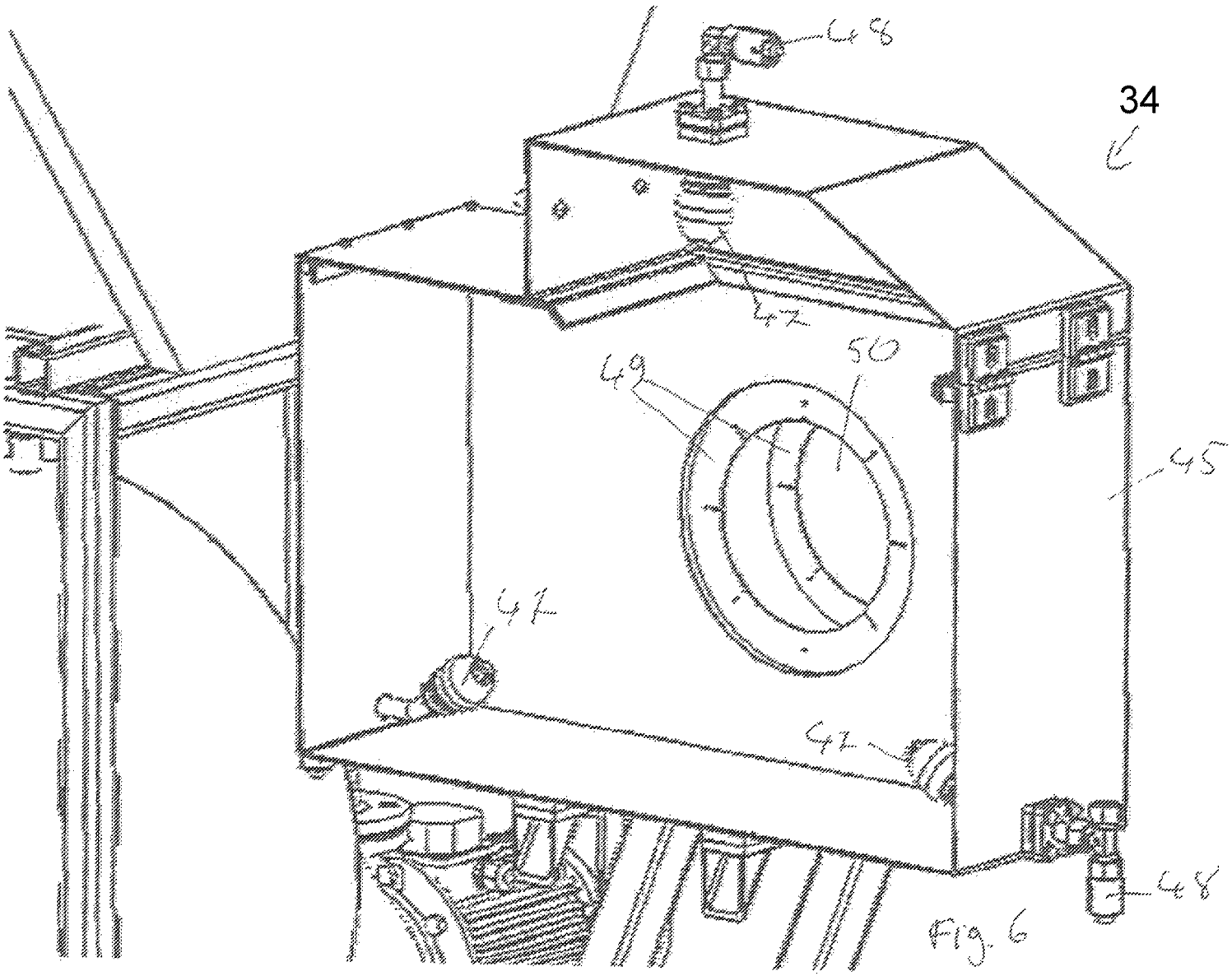
FIG. 6 shows a sectional view of a cleaning device.

FIG. 6 shows a sectional view of a cleaning device 34 which is realized as a high-pressure cleaning device and therefore has three high-pressure nozzles 47 inside a housing 45, high-pressure nozzles 47 being integrated into heat transfer medium cycle 13 via corresponding connections 48. Connections 48 are indirectly or directly connected to high-pressure pump 42 by means of a corresponding heat transfer line (not shown in FIG. 6) in order to apply the water or the heat transfer medium to the workpiece via high-pressure nozzles 47.

High-pressure nozzles 47 are disposed at an angle of 120° to one another, an effective cleaning of the entire surface of the workpiece thus being achievable. Housing 45 of high pressure cleaning device 34 has closing and locking means so that housing 45 can be opened and closed. Furthermore, FIG. 6 shows a discharge opening 50 of cleaning device 34 which is provided with corresponding sealing means 49 and through which the workpiece can leave cleaning device 34.

REFERENCE SIGNS

10 preheating device
11 heat exchanger device
12 preheating chamber
13 heat transfer medium cycle
14 fluid flow connection
15 fluid flow line
16 fluid flow line section
17 chimney connection section
18 heat transfer line
19 supply line
20 return line
21 heat transfer medium tank
22 circulator pump device
23 reception area
24 workpiece
25 liquid discharge device
26 upper side
28 discharge opening
29 bypass line
30 shut-off valve device
31 shut-off valve device
32 reception device
33 transport shaft
34 cleaning device
37 collection device
39 circulator pump
40 backwash filter
41 outlet
42 high-pressure pump
43 inlet
45 housing
46 coarse dirt filter

47 high-pressure nozzle
48 connections
49 sealing means
50 discharge opening
A exhaust gas flow
T transport direction

The invention claimed is:

1. A device (10) for preheating rod-shaped, metallic workpieces (24) by means of a fluid flow heated by residual or waste heat of a combustion process taking place in a heating device for heating the workpieces (24), the device (10) comprising:

a preheating chamber (12) for receiving at least one workpiece (24), a heat exchanger device (11) having a flow path for the fluid flow and a liquid medium path for a heat transfer medium flow, the liquid medium path being in heat exchange relationship with the flow path for the fluid flow in the heat exchanger in order to transfer heat from the fluid flow to the heat transfer medium flow in the liquid medium path, wherein the liquid medium path defines a heat transfer medium cycle (13) between the heat exchanger device (11) and the preheating chamber (12) in such a manner that the workpiece (24) is preheated indirectly via the heat transfer medium flow heated by the fluid flow in the heat exchanger device (11) and flowing to a liquid discharge device (25) of the preheating chamber (12), wherein the liquid discharge device (25) extends parallel to the longitudinal axis (L) of the workpiece (24) disposed in a reception area (23) of the preheating chamber (12), and wherein the liquid discharge device (25) has a row of discharge openings (28) for realizing a substantially continuous wetting on the upper side (26) of the workpiece (24) with heat transfer medium, the row of discharge openings (28) extending in the longitudinal direction of the preheating chamber (12).

2. The device according to claim 1, wherein the preheating chamber (12) has the shape of a tube and a liquid discharge device (25) for applying the heat transfer medium flow leaving the liquid discharge device (25) to an upper side (26) of the workpiece (24), the liquid discharge device (25) being disposed above a reception area (23) for receiving the workpiece (24).

3. The device according to claim 1, wherein the preheating chamber (12) is realized as a through-flow chamber and has an inlet seal realized on a first end face and an outlet seal realized on an opposite end face.

4. The device according to claim 1, wherein the heat exchanger device (11) and the preheating chamber (12) are disposed in a heat transfer medium cycle (13) in such a manner that a supply line (19) is realized between the heat exchanger device (11) and the preheating chamber (12) and a return line (20) is realized between the preheating chamber (12) and the heat exchanger device (11).

5. The device according to claim 4, wherein a heat transfer medium tank (21) is disposed between the preheating chamber (12) and the return line (20) in such a manner that the heat transfer medium flow discharged from the liquid discharge device (25) into the reception area (23) of the preheating chamber (12) is transported from the preheating chamber (12) into the heat transfer medium tank (21) and from the heat transfer medium tank (21) into the heat exchanger device (11).

6. The device according to claim 5, wherein a bypass line (29) is disposed parallel to the preheating chamber (12) between the supply line (19) and the heat transfer medium tank (21), the bypass line (29) and a supply line section connecting the bypass line (29) and the preheating chamber (12) each being provided with a shut-off valve device (30, 31).

7. The device according to claim 4, wherein the heat transfer medium cycle (13) comprises a cleaning device (34), the cleaning device (34) comprising at least one additional liquid discharge device (47) for applying the heat transfer medium flow leaving the liquid discharge device (47) to a surface of the workpiece (24).

8. The device according to claim 7, wherein the heat transfer medium cycle (13) has a branch in the supply line (19) between the heat exchanger device (11) and the preheating chamber (12), the heat transfer medium being supplied to the cleaning device (34) by means of the branch.

9. The device according to claim 7, wherein the cleaning device (34) comprises a collection device (37) which collects the heat transfer medium applied to the workpiece (24) by means of the cleaning device (35).

10. The device according to claim 9, wherein the collection device (37) opens into a return line (20) which is realized between the preheating chamber (12) and the heat exchanger device (11).

11. The device according to claim 9, wherein the collection device (37) is realized as a common collection device (37) of the cleaning device (35) and the liquid discharge device (25).

12. The device according to claim 7, wherein the cleaning device (34) is a high-pressure cleaning device.

13. The device according to claim 4, wherein the supply line (19) and/or the return line (20) comprise(s) filter means (40, 46) for filtering dirt from the heat transfer medium cycle (13).

14. The device according to claim 1, wherein the preheating chamber (12) is provided with at least one reception device (32) for the supporting reception of the workpiece (24), wherein the reception device (32) can be adapted to the workpiece geometry.

15. The device according to claim 14, wherein the reception device (32) is realized as a transport device for transporting the workpiece (24) in the longitudinal direction of the preheating chamber (12).

16. The device according to claim 14, wherein the reception device is realized as a rotation device for rotating the workpiece (24) about the longitudinal axis of the workpiece.

17. The device according to claim 1, wherein the metallic workpieces (24) are aluminum rods.

* * * * *